US007121306B2

(12) United States Patent
Harrison

(10) Patent No.: US 7,121,306 B2
(45) Date of Patent: Oct. 17, 2006

(54) INDUSTRIAL FABRIC INCLUDING YARN ASSEMBLIES

(75) Inventor: James Harrison, Kanata (CA)

(73) Assignee: Astenjohnson, Inc., Charleston, SC (US)

( * ) Notice: Subject to any disclaimer, the term of this patent is extended or adjusted under 35 U.S.C. 154(b) by 0 days.

(21) Appl. No.: 10/482,490

(22) PCT Filed: Jul. 3, 2002

(86) PCT No.: PCT/US02/21005

§ 371 (c)(1),
(2), (4) Date: Aug. 25, 2004

(87) PCT Pub. No.: WO03/004736

PCT Pub. Date: Jan. 16, 2003

(65) Prior Publication Data

US 2004/0261883 A1 Dec. 30, 2004

Related U.S. Application Data

(60) Provisional application No. 60/303,273, filed on Jul. 5, 2001.

(51) Int. Cl.
*D03D 47/02* (2006.01)

(52) U.S. Cl. ..... 139/440; 139/426 R; 139/420 R

(58) Field of Classification Search ..... 139/440, 139/426 R, 420 R; 442/197, 199; 428/373, 428/374

See application file for complete search history.

(56) References Cited

U.S. PATENT DOCUMENTS 2,025,039 A 12/1935 Cannon
2,074,693 A 3/1937 Hooper
2,180,054 A * 11/1939 Hindle et al. ..... 139/408
2,269,869 A * 1/1942 Specht ..... 139/425 R
2,544,373 A 3/1951 West
3,143,150 A * 8/1964 Buchanan ..... 139/425 A
4,407,333 A 10/1983 Fowkes
4,592,396 A * 6/1986 Borel et al. ..... 139/425 A
4,636,426 A * 1/1987 Fleischer ..... 442/149
4,829,681 A * 5/1989 Josef ..... 34/123
4,934,414 A * 6/1990 Borel ..... 139/383 A
5,097,872 A * 3/1992 Laine et al. ..... 139/426 R
5,366,798 A 11/1994 Ostermayer
5,429,686 A * 7/1995 Chiu et al. ..... 139/383 A
5,465,764 A * 11/1995 Eschmann et al. ..... 139/383 A
5,487,414 A * 1/1996 Kuji et al. ..... 139/383 A
5,555,917 A * 9/1996 Quigley ..... 139/383 A
5,613,527 A * 3/1997 Zimmermann et al. . 139/383 A
5,617,903 A * 4/1997 Bowen, Jr. ..... 139/383 A
5,799,708 A * 9/1998 Josef ..... 139/383 A
5,826,627 A * 10/1998 Seabrook et al. ..... 139/383 A
5,829,489 A * 11/1998 Kuji ..... 139/383 A (Continued)

FOREIGN PATENT DOCUMENTS

EP 0 580 478 1/1994

(Continued)

*Primary Examiner*—John J. Calvert
*Assistant Examiner*—Robert H Muromoto
(74) *Attorney, Agent, or Firm*—Volpe and Koenig, P.C.

(57) ABSTRACT

A woven industrial fabric, including a plurality of warp yarns interwoven with a plurality of weft yarns. At least a portion of one of the plurality of warp and the plurality of weft yarns includes yarn assemblies. Each yarn assembly is comprised of at least a first and a second yarn. The yarns are structured and arranged in the woven fabric so as to be in generally continuous, contiguous contact with each other substantially throughout the fabric.

28 Claims, 12 Drawing Sheets

U.S. PATENT DOCUMENTS 5,944,062 A * 8/1999 Gampe ..... 139/383 A
6,123,116 A * 9/2000 Ward et al. ..... 139/383 A
6,124,015 A * 9/2000 Baker et al. ..... 428/99
6,189,577 B1 * 2/2001 Lee ..... 139/383 A
6,548,429 B1 * 4/2003 Lintecum et al. ..... 442/199
6,589,392 B1 * 7/2003 Skinner et al. ..... 162/348
6,827,821 B1 * 12/2004 Brewster et al. ..... 162/358.2
6,905,574 B1 * 6/2005 Festor ..... 162/348
6,926,043 B1 * 8/2005 Quigley et al. ..... 139/383 A

FOREIGN PATENT DOCUMENTS

EP 0 802 280 10/1997
EP 1 054 097 4/2000
WO WO 91/19044 12/1991
WO WO 01 21884 3/2001

* cited by examiner

INDUSTRIAL FABRIC INCLUDING YARN ASSEMBLIES

CROSS-REFERENCE TO RELATED APPLICATIONS

This application is a 371 National Phase of PCT/US02/21005, filed Jul. 3, 2002, which claims the benefit of U.S. Provisional Application No. 60/303,273, filed Jul. 5, 2001.

FIELD OF THE INVENTION

The present invention relates generally to woven industrial fabrics having at least one system of weft yarns and at least one system of warp yarns in which either, or both, the warp and weft yarn systems is comprised of yarn assemblies formed by at least a first yarn and a second yarn which are structured and arranged so as to be in generally continuous, contiguous contact with one another over substantially their entire weave path through the industrial fabric. The composition, orientation, surface characteristics and shape of the yarns forming the yarn assemblies may be selected to suit end use requirements.

BACKGROUND OF THE INVENTION

The present invention relates to an improved industrial fabric which is particularly suitable for papermaking and related filtration applications to aid in forming, dewatering and conveying a web through a papermaking or like machine. The requirements and desirable characteristics of papermaker's fabrics vary depending on the particular section of the papermaking machine where the fabric is intended to be used, and the paper product being manufactured. The vast majority of these fabrics are of woven construction. Many types are known in the art, including those with single layer, double or triple layer construction. These fabrics are either flat or endlessly woven according to techniques well known in the art and are seamed to facilitate their installation on the papermaking machine.

Papermaker's fabrics must generally satisfy a number of physical requirements simultaneously: they must be dimensionally stable and have a reasonably high tensile strength, so as to resist the stresses to which they are exposed; they must be resistant to high temperatures and compressive loading; and they must be reasonably resistant to the effects of abrasion caused by their movement over bearing surfaces in the machine. Other requirements are known. To satisfy at least some of these requirements, manufacturers of papermaker's fabrics have developed various weave designs and fabric constructions which allow the properties of one or both fabric surfaces to be customized for end use conditions. One method of doing this is to cause the yarns in either, or both, the warp and weft systems to be stacked so that the individual yarns of each system are in vertical alignment with each other.

Woven industrial fabrics comprised of stacked warp and/or weft yarns are known in the art. See, for example, U.S. Pat. Nos. 5,066,532 and 5,857,497 to Gaisser, U.S. Pat. Nos. 5,167,261, 5,092,373 and 5,230,371 to Lee, U.S. Pat. No. 6,158,478 to Crosby et al., U.S. Pat. No. 5,503,196 to Josef et al., and U.S. Pat. No. 5,503,196 to Kositzke. Others are known and used. The known fabrics comprised of stacked warp and/or weft yarns are at least double layer structures, meaning they have at least two systems of either, or both, warp or weft yarns. In these known fabrics, at least a portion of either the warp yarns, or the weft yarns, or both, from one yarn system are arranged in the weave pattern so as to be in a vertically stacked relationship over the corresponding yarns in the second yarn system in the woven fabric structure.

In all of the known fabrics in which each of at least a portion of the component yarns of one system are vertically stacked over a corresponding yarn of a second system to form e.g., a pair, the component yarns of a pair are not in intimate contact over their entire path length through the fabric. There is always at least one intervening yarn located between a stacked pair in the weave repeat. This is because the weave patterns of at least some of these prior art fabrics are designed so as to stabilise the stacked yarns in their vertical orientation so that they are maintained in this position one above the other.

The prior art fabrics wherein the warp and/or weft yarns are vertically stacked provide numerous advantages over other fabrics in which at least a portion of the component yarns are not stacked. For example, the weave paths of stacked yarns can be arranged so that one yarn system forms a portion of only one fabric surface, while the other yarn system forms a portion of the opposite fabric surface. This feature can be utilised to locate temperature resistant, or abrasion resistant, materials on one surface of the fabric so as to increase its operational life. In certain weave constructions, fabrics with stacked yarn systems can also provide improved seam strength and reduced seam marking when compared to fabrics where the yarn systems are not stacked. In addition, it is also possible to obtain relatively high air permeability and open area in a stable fabric structure, increased fabric surface area contact and smoothness when compared to non-stacked designs, and high fabric warp fill. Thus, it is recognised in the art that fabrics having stacked yarn systems can provide numerous advantages, depending on their intended end use, when compared to fabrics in which the component yarns are arranged in a non-stacked relation.

However, it has now been recognised that these known fabrics suffer from several limitations due to the manner in which the component yarns are arranged. First, the number of possible weave designs available which will allow one of the component yarns of one yarn system to be located predominantly on one fabric surface, while causing the component yarns of the second yarn system to be located predominantly on the opposed fabric surface, is somewhat limited. Second, the number of seam designs available for use in these prior art fabric structures to create a high strength, low marking seam to join the opposed fabric ends is also limited. Third, it is not possible in a single layer fabric (one having a single system of warp and weft yarns) to provide differing yarn materials on each of the fabric surfaces without post-treating the fabric (e.g. by applying a coating or an additional layer of material such as a non-woven batt or film to one surface).

It would therefore be desirable if a woven industrial fabric of any chosen design can be provided wherein the physical characteristics of the two opposed fabric surfaces can be different, the seam has reduced potential to mark the sheet and is of high strength, the seaming loops can be orthogonal to the plane of the fabric, and which also offers improved economy of manufacture.

Accordingly, the present invention seeks to provide an industrial fabric, in particular a papermaker's fabric or filtration fabric, whose construction is intended at least to ameliorate the aforementioned deficiencies of the prior art.

It has now been discovered that it is possible to weave, or assemble, an industrial fabric using a plurality of yarn assemblies. The yarn assemblies may be used as either, or both, the warp and weft systems in the fabric. Each yarn assembly is comprised of at least two yarn members which are arranged so as to be in generally continuous intimate contact over their entire weave path through the industrial fabric with no yarns from another system intervening between any yarn members in the fabric.

SUMMARY OF THE INVENTION

In a first broad embodiment, the present invention seeks to provide a woven industrial fabric including a plurality of warp yarns interwoven with a plurality of weft yarns, wherein:

a) at least a portion of one of the plurality of warp yarns and the plurality of weft yarns includes a plurality of yarn assemblies;

b) each of the plurality of yarn assemblies is comprised of at least a first and a second yarn; and c) the first and second yarns are arranged in the woven fabric so as to be in generally continuous, contiguous contact with each other substantially throughout the fabric.

BRIEF DESCRIPTION OF THE DRAWINGS

For the purpose of illustrating the invention, there is shown in the drawings embodiments which are presently preferred. It is understood, however, that the present invention is not limited to the precise arrangements and instrumentalities shown. In the drawings.

DETAILED DESCRIPTION OF THE PREFERRED EMBODIMENTS

Figure 1:
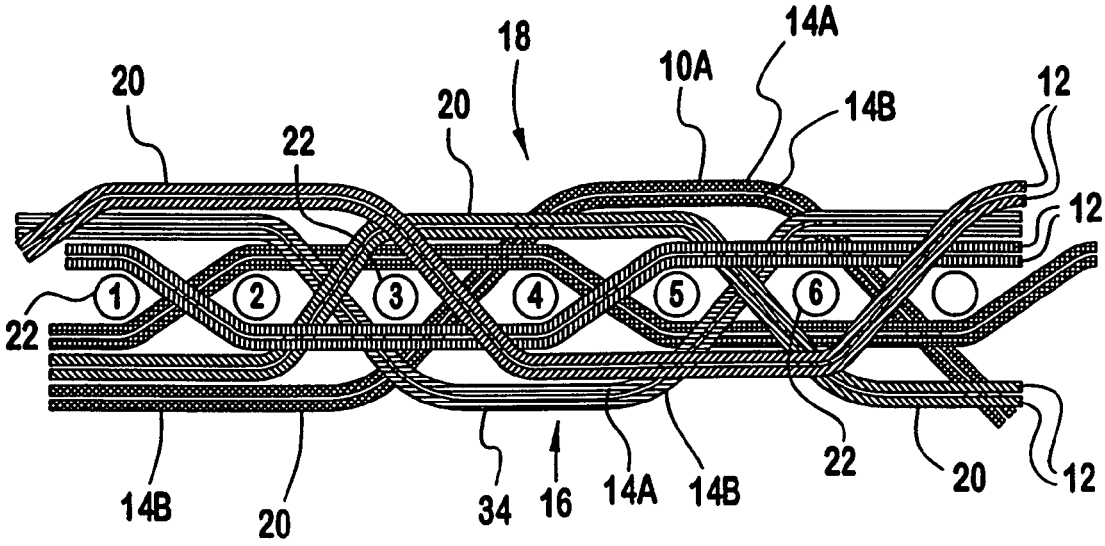
FIG. 1 is a side view showing the arrangement of warp and weft yarns in a first preferred embodiment of an industrial fabric according to the present invention.

Certain terminology is used in the following for convenience only and is not limiting. As used herein, the term "yarn assembly" refers to a group of two or more yarns, preferably monofilaments, which are woven together essentially as one yarn in the fabric. The two or more yarns in a yarn assembly are maintained in a generally vertically stacked arrangement so as to be in generally continuous intimate contact over their entire weave path through an industrial fabric except adjacent the fabric seam areas. All of the yarns in one yarn assembly follow the same path through the fabric, and maintain the same relative orientation with respect to one another (when the yarn assembly is viewed in cross-section) over generally the entire length of the yarn assembly path except, optionally, adjacent the seam area at the opposed fabric edges. The yarns may have cross-sections that are generally rectangular, square, trapezoidal or they may have any other geometric shape. A yarn assembly is distinct from a multifilament yarn in that the component yarns comprising the yarn assembly are not twisted, plied or intertwined about each other and about a generally central longitudinal yarn axis.

The words "right," "left," "lower" and "upper" designate directions in the drawings to which reference is made. The words "inwardly" and "outwardly" refer to directions toward and away from, respectively, the geometric center of the industrial fabric and designated parts thereof. The terms "MD" and "CMD," as used in the specification and in the claims, mean "machine direction" and "cross-machine direction," respectively and refer to the direction of movement of the fabric through the papermaking machine and a direction perpendicular to this in the plane of the fabric. Throughout the detailed description the MD yarns are also referred to as warp yarns and the CMD yarns are also referred to as weft yarns. This description is appropriate as the fabrics of the present invention are preferably flat woven. It is understood that when the fabrics of the present invention are endlessly woven, the MD yarns are the weft yarns and the CMD yarns are the warp yarns. Additionally, the word "a," as used in the claims and in the corresponding portions of the specification, means "at least one," unless specifically noted otherwise.

Referring to the drawings in detail, wherein like numerals indicate like elements throughout, FIGS. 1–30 illustrate preferred embodiments of an industrial fabric according to the present invention, generally designated 10A, 10B, 10C, 10D and 10E. The industrial fabrics 10A–10E have yarn assemblies 12 each having at least first and second yarns 14A, 14B directly stacked one on top of the other. By using first and second yarns 14A, 14B formed of different materials, the surfaces 16, 18 of the industrial fabric can each be predominantly formed by a separate material in an economic fashion to allow the physical surface properties of each fabric surface 16, 18 to be customized. While the present invention can be used to produce a variety of woven industrial fabrics, the preferred use of industrial fabrics 10A–10E produced according to the present invention is as a papermaker's fabric or a filtration device 10A–10E. While the yarns 14A, 14B of the yarn assemblies 12 are illustrated and discussed as being directly stacked one on top of the other this is for convenience only. The yarns 14A, 14B may also be arranged in other manners as will be shown.

It is preferred that the woven industrial fabrics 10A–10E of the present invention are manufactured using flat weaving techniques. However, those of ordinary skill in the art will appreciate from this disclosure that fabrics 10A–10E can also be formed using endless weaving without departing from the scope of the present invention.

FIGS. 1–10 illustrate the weave for five preferred industrial fabrics 10A–10E. The preferred weaves are discussed in detail below. However, prior to discussing the preferred weaves, a more general discussion of the fabrics 10A–10E of the present invention is set forth.

Referring to FIGS. 1, 3, 5, 7 and 9, the industrial fabric 10A–10E includes a plurality of CMD yarns 22 interwoven with a plurality of MD yarns 20. At least a portion of one of the plurality of MD yarns 20 and the plurality of CMD yarns 22 comprise a plurality of the yarn assemblies 12 having a first and second yarn 14A, 14B directly stacked one on top of the other so as to be generally in contact with each other substantially throughout the fabric 10A–10E. In the preferred embodiments illustrated at least a portion of the MD yarns 20 are comprised of the yarn assemblies 12. Although not illustrated, at least a portion of the CMD yarns 22 could also be comprised of the yarn assemblies 12. As will be detailed below, a portion of the fabric 10A–10E proximate to a seam edge 24 (shown in FIGS. 11–15 and 27–30) defines a seam zone 26 having a plurality of seam loops 28.

Some of the MD yarns 20 that form seam loops 28 can extend between paired CMD yarns 22 in the seam zone 26. Accordingly, those of ordinary skill in the art will appreciate from this disclosure that first and second yarns 14A, 14B can be directly stacked one on top of the other with a cross direction yarn extending therebetween while still being generally in contact with each other substantially throughout the fabric 10A–10E. One of ordinary skill in the art will also appreciate from this disclosure that stacked first and second yarns 14A, 14B can be separated to form a seam loop 28 (further described below) proximate to the seam edge 24 while still being generally in contact with each other substantially throughout the fabric 10A–10E.

Figure 28:
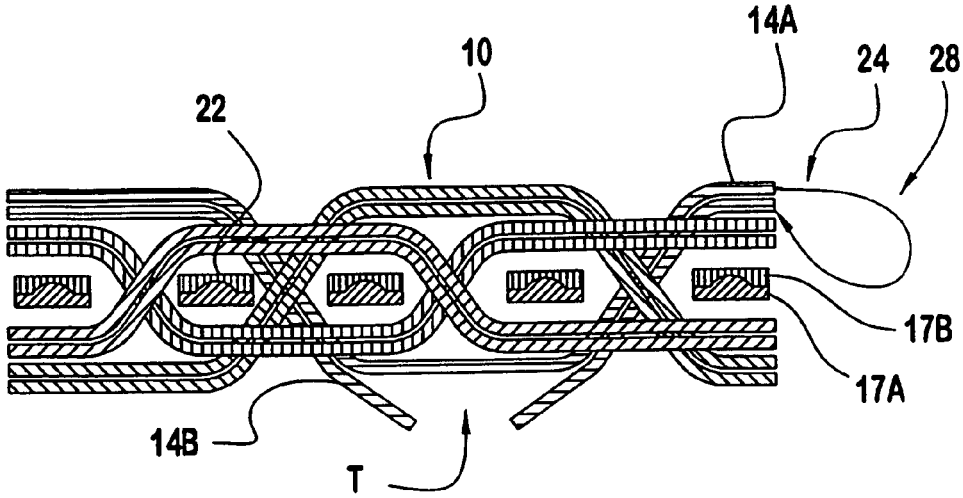
FIG. 28 is a schematically drawn side view of an industrial fabric according to the present invention with paired MD yarns and paired CMD yarns having interlocking cross-sectional shapes.
Figure 29:
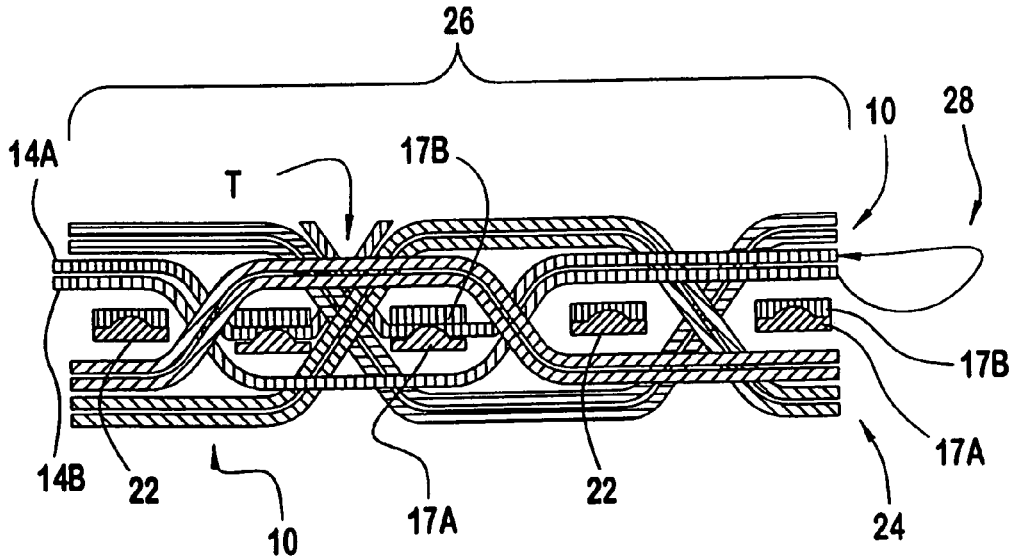
FIG. 29 is a schematically drawn side view of an industrial fabric according to the present invention with paired MD yarns and paired CMD yarns having interlocking cross-sectional shapes, wherein a seam loop forming yarn is back woven into the fabric and inserted between some of the paired CMD yarns.
Figure 30:
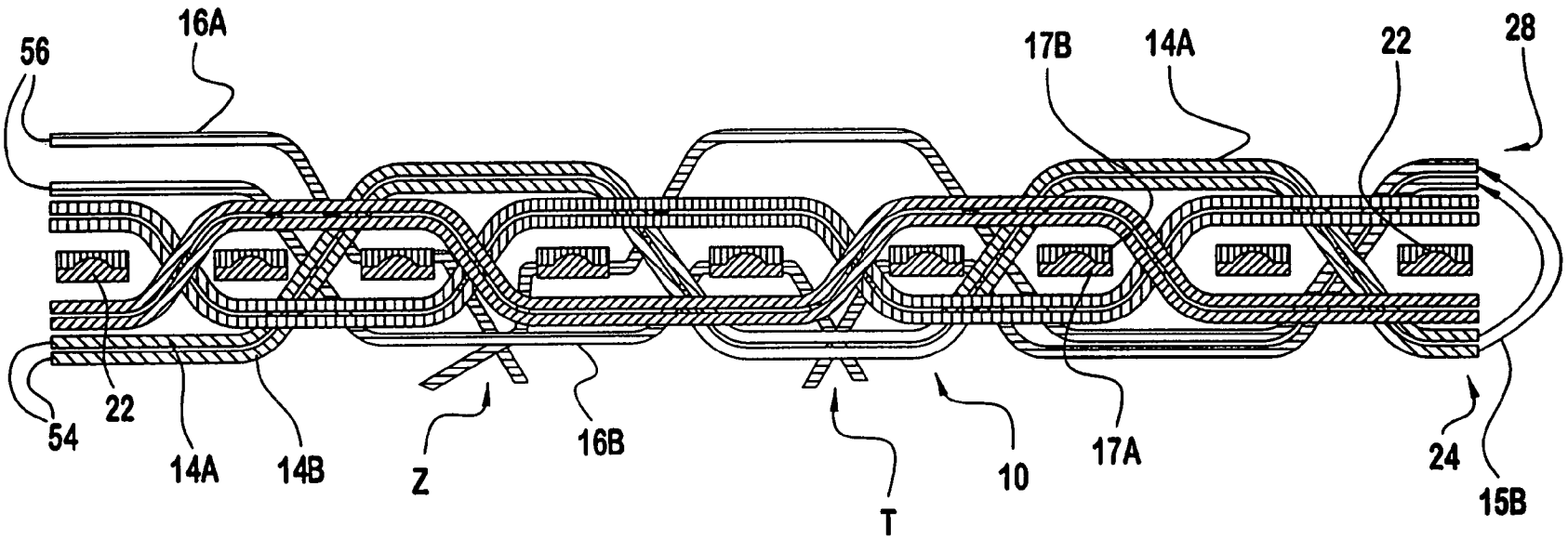
FIG. 30 is a schematically drawn side view of an industrial fabric according to the present invention with paired CMD yarns having interlocking cross-sectional shapes, wherein paired MD yarns and paired seam loop forming yarns are back woven into the fabric and inserted through some of the paired CMD yarns.

It is preferred that at least a portion of the MD yarns 20 include yarn assemblies 12 which may be pairs of yarns 14A, 14B. Alternatively, it is preferred, but not necessary, that at least a portion of the CMD yarns 22 include yarn assemblies 12. As shown in FIGS. 28–30 at least a portion of the MD yarns 20 and at least a portion of the CMD yarns 22 can also include yarn assemblies 12 without departing from the scope of the present invention.

It is preferred, but not necessary, that the first yarn 14A is formed from a first material and that the second yarn 14B is formed from a second material that is different from the first material. The first yarn 14A is preferably, but not necessarily, located generally above the second yarn 14B in each of the yarn assemblies 12. The stacked relationship between the first and second yarns 14A, 14B causes the upper surface of the fabric 10A–10E to be generally formed by first yarns 14A and the lower surface of the fabric 10A–10E to be generally formed by second yarns 14B. The forming of each fabric surface 16, 18 by yarns of a particular material allows the surfaces of the fabric 10A–10E to have different physical surface properties. When the fabric 10A–10E of the present invention is used as a papermaker's fabric, the fabric 10A–10E has an upper paper side surface 18 and a lower machine side surface 16 each of which can be customized to have specific physical surface properties via the selection of appropriate yarn materials and yarn profiles.

It is preferred, but not necessary, that the first and second yarns 14A, 14B of the yarn assemblies 12 are pre-stacked as an assembly prior to weaving. This allows the stacked MD yarns 20 to be run together through heddles while CMD weft, or filler, yarns 22 are inserted into the sheds created by the MD yarns 20. Alternatively, the yarn assemblies 12 can be individually run through common heddles or run through adjacent heddles and then stacked during weaving.

Once the industrial fabric 10A–10E is formed in this manner, the first surface 18 of fabric 10A–10E, which may be a paper side surface, has mechanical properties corresponding to the first material and a second side surface 16, which may be the machine side surface, has mechanical properties corresponding to the second material. Possible combinations of first and second materials are: polyphenylene sulfide (PPS) and polycyclohexamethylene terephthalic acid modified (PCTA), PPS and polyethylene terephthalate (PET), and PCTA and PET, respectively. However, those of ordinary skill in the art will appreciate from this disclosure that other materials can be selected depending upon the desired mechanical properties to be imparted to the machine side surface 16 and the paper side surface 18 of the fabric 10A–10E without departing from the scope of the present invention.

It is preferred, but not necessary, that the first yarn 14A be textured to provide a desired surface characteristic to the paper side surface 18 of the fabric 10A–10E. The first yarn 14A can be textured by one of: placing ribs thereon, placing grooves therein, roughening, and/or placing a coating thereover. Alternatively, the machine side surface 16 can incorporate similar textured yarns without departing from the scope of the present invention. The yarns 14A and 14B may also be of differing size and may be arranged so that alternating thick and thin yarns are located in the machine side surface. In this way a grooved fabric surface can be formed. It would also be possible to use a grooved yarn to create a similar effect.

Referring to FIGS. 16–19 and 22, the fabric 10A–10E of the present invention can be formed with first and second yarns 14A, 14B having complementary, cross-sectional shapes such that the first and second yarns 14A, 14B cooperatively interlock to resist misalignment. By using interlocking first and second yarns 14A, 14B, the fabric 10A–10E can have longer floats 34 (as measured by the number of cross-direction yarns over which the float 34 passes) than otherwise possible. Fabrics 10A–10E having longer yarn floats 34 can provide a fabric having greater wear surface area and contact area with the sheet.

Figure 16:
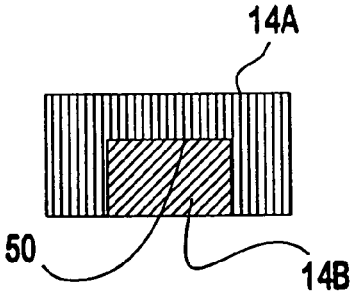
FIGS. 16–19 and 22 are cross-sectional views of yarn assemblies in accordance with the invention having complementary cross-sectional shapes such that the first and second yarns cooperatively interlock to resist misalignment.
Figure 17:
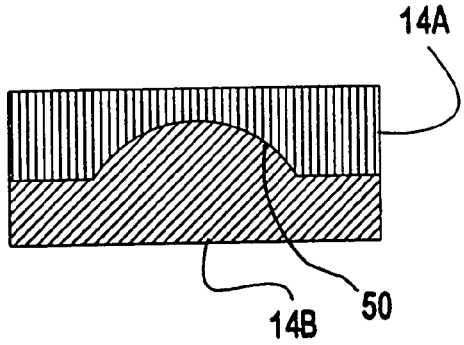
Figure 18:
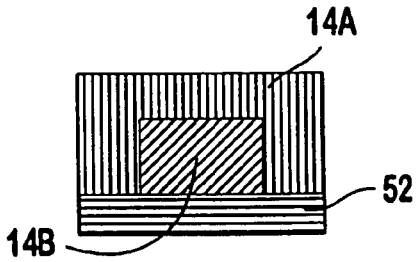
Figure 19:
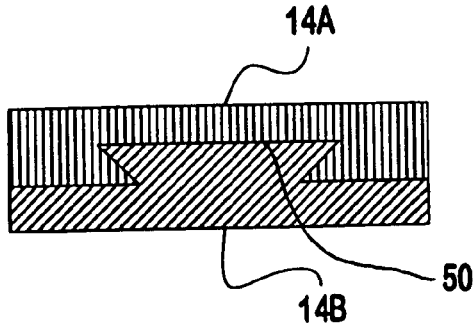
Figure 22:
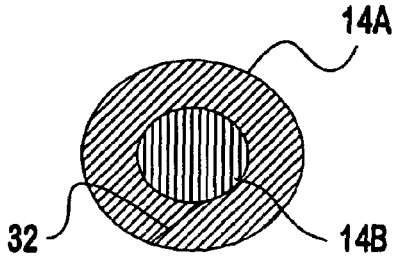
Figure 23:
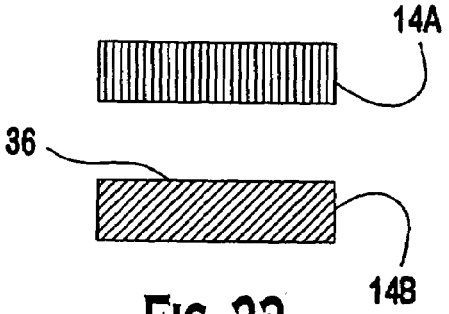

Referring to FIG. 16, the first yarn 14A can have a generally rectangular cross-sectional shape with a groove 50 therein for receiving the second yarn 14B. Referring to FIG. 17, the second yarn 14B can have a generally rectangular cross-sectional shape with a protruding semicircular portion that engages a groove 50 in the first yarn 14A. Referring to FIG. 18, the interlocking yarns of FIG. 16 can include a third yarn 52 that, in combination with first yarn 14A, surrounds second yarn 14B. Referring to FIG. 19, second yarn 14B includes a generally trapezoidal projection that is interlocked with a correspondingly shaped groove 50 in the first yarn 14A. Referring to FIG. 22, first yarn 14A has a generally annular shape with a radial gap 32 positioned through one side to allow the second yarn 14B to be pressed therein. While preferred interlocking, cross-sectional yarn shapes are shown, those of skill in the art will appreciate that the present invention is not limited to particular interlocking, cross-sectional yarn shapes, but includes any interlocking yarn shapes, such as irregular, interlocking yarn shapes. While FIGS. 28–30 show first and second yarns 14A, 14B having complementary cross-sectional interlocking shapes used as CMD yarns 22, those of ordinary skill in the art will appreciate that the MD yarns 20 can also be formed with first and second yarns 14A, 14B having a complementary, cross-sectional interlocking shape.

The use of stacked first and second yarns 14A, 14B that interlock to form rigid yarn assemblies 12 allows at least a portion of the yarn assemblies 12 to form floats 34 which preferably extend over at least four (4) cross-direction yarns. First and second yarns 14A, 14B having interlocking cross-sectional configurations undergo less lateral slippage which allows fabrics 10A–10E to have longer exposed floats 34.

Figure 20:
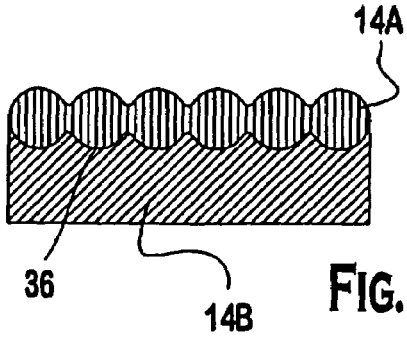
FIGS. 20, 21, 23 and 24 are cross-sectional views of yarn assemblies in accordance with the present invention in which the first yarn has a generally rectangular, cross-sectional area and the second yarn comprises one or more yarns located in continuous contiguous contact on the first yarn.
Figure 24:
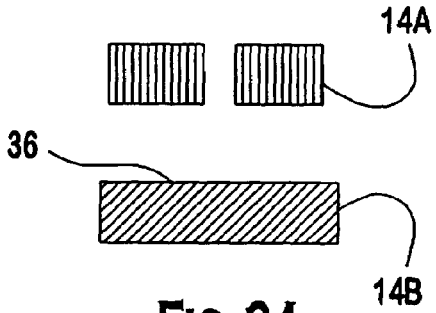

Referring to FIGS. 20 and 24, the fabric 10A–10E of the present invention can include yarn assemblies 12 having a plurality of first yarns 14A in stacked relationship with a second yarn 14B so that each of the at least two first yarns 14A is generally in contact with the second yarn 14B substantially throughout the fabric 10A–10E. Those of ordinary skill in the art will appreciate from this disclosure that at least two second yarns 14B can be disposed in a stacked relationship with a single first yarn 14A and that the first yarn(s) 14A can form either the paper side surface 16 or the machine side surface 18 of the fabric 10A–10E without departing from the scope of the present invention.

Figure 21:
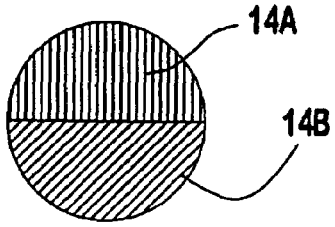

When a single yarn 14A or 14B is stacked with at least two yarns 14B, 14A, it is preferable, but not necessary, that the first yarn 14A have a generally rectangular, cross-sectional shape providing a yarn receiving surface 36 for receiving the at least two second yarns 14B. It is preferable that at least one yarn receiving groove be located in the yarn receiving surface 36 to receive the at least two stacked yarns 14A or 14B. Alternatively, a separate yarn receiving groove can be provided in the yarn receiving surface 36 for each of the at least two yarns 14A or 14B extending thereover to prevent misalignment between the yarn providing the yarn receiving surface 36 and the at least two yarns stacked thereon. As shown in FIG. 24, the at least two first yarns 14A (or second yarns 14B depending on the fabric 10A–10E) can each have a generally rectangular, cross-sectional shape. As shown in FIG. 21, the at least first and second yarns 14A, 14B can each have a generally semicircular cross-section so that when the first and second yarns 14A, 14B are in continuous, contiguous contact, the resulting yarn assembly has a generally circular cross-section.

The fabrics 10A–10E of the present invention can be formed using stacked first and second yarns 14A, 14B having different thicknesses in either the MD or the CMD direction. Thus, the fabric 10A–10E can be assembled first yarns 14A with a first cross-sectional area and shape and second yarns having a second cross-sectional area and shape that is different than the first cross-sectional area and shape.

Figure 25:
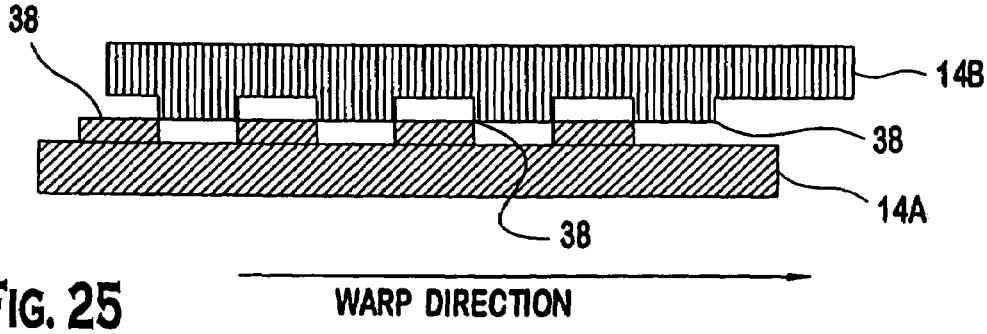
FIG. 25 is an elevational view of first and second yarns each having complementary, spaced apart protuberances for interlocking the first and second yarns so as to form a yarn assembly.

Referring to FIG. 25, the fabric 10A–10E can be manufactured with MD, or CMD, yarn assemblies including first and second yarns 14A, 14B each having a plurality of complementary, spaced apart protuberances 38 capable of interlocking the first yarn 14A to the second yarn 14B.

Referring to FIGS. 9, 11–15 and 27, it is preferred that at least a portion of the MD yarns 20 include yarn assemblies 12 and that the CMD yarns 22 are arranged as a plurality of generally stacked CMD yarn sets 40, each including at least two spaced apart CMD yarns 22. Those of ordinary skill in the art will appreciate from this disclosure that each of the stacked, spaced apart CMD yarns 22 can actually be formed by one yarn assembly of two or more yarns (with or without interlocking cross-sectional shapes) 12.

The use of two, or more, layers of CMD yarns 22 allows back woven yarn ends (further detailed below) to terminate generally between the stacked CMD yarn sets 40 which prevents any marring of the paper side surface 18 or the machine side surface 16 of the fabric 10A–10E. The fabric 10A–10E preferably includes at least one seam forming edge 24 that has seam loops 28 to allow the fabric to be formed into an endless belt configuration.

Referring to FIGS. 11–15, one method of forming seam loops 28 (additional methods of forming seam loops will be described in detail below) is to form the loops 28 from the first yarn 14A of the yarn assemblies 12 while the second yarn 14B is terminated at a location spaced from the seam forming edge 24. After the loop 28 is formed by the first yarn 14A, the first yarn 14A is back woven into the fabric 10A–10E along a second yarn path proximate to the location T where the second yarn 14B was terminated. The second yarn 14B can be terminated proximate to either one of the machine side surface 16 and the paper side surface 18. However, it is preferred that the second yarn 14B is terminated generally between one of the generally stacked CMD yarn sets 40. Alternatively, the seam loops 28 along the seam forming edge 24 of the fabric 10A–10E can each be formed by one of the sets of yarn assemblies 12 (as shown in FIG. 30). Depending upon the back weaving technique used to form the seam loops 28, the fabric 10A–10E can be manufactured such that each of the plurality of yarn assemblies 12 is free of any yarns interwoven between the corresponding first and second yarns 14A, 14B.

While the fabric 10A–10E of the present invention has been broadly described above, the weave for five (5) preferred fabrics (shown in FIGS. 1–10) will be discussed below. In each of the following examples, the fabric 10A–10E is woven using a flat weaving process. It should be understood, however, that the present invention can be practiced with endless weaving or fabric assembly methods (such as those described in U.S. Patent Applications Nos. 60/194,163 and 60/259,974 which are each hereby incorporated by reference herein in their entirety as if fully set forth) without departing from the present invention. For example, the principles of the present invention can be practiced in fabrics formed using pre-crimped yarn components. Such fabrics are assembled, at least in part, from a plurality of pre-crimped polymeric components, particularly yarns, strips and the like. Crimp is imparted to the components prior to their assembly so as to provide dimensioned indentations that will be generally complementary, in shape and size, to the components with which they are to be assembled or mated. The complementary indentations allow for the yarns to be assembled into stacked generally contiguous continuous contact in accordance with the present invention.

Since the presently preferred fabrics 10A–10E discussed below are flat woven, the stacked MD yarn assemblies 20 form the warp yarns and are preferably placed through heddles, either separately or pre-stacked, to allow the MD warp yarn assemblies 20 to be moved into the desired shed configuration. It is preferred that the fabric 10A–10E be formed by moving the MD warp yarns assemblies 20 into the appropriate shed configuration and then inserting a CMD weft yarn 22, or stacked, paired CMD weft yarns 22, through the shed. Afterwards, a beat-up bar or the like is used to firmly abut the newly inserted CMD yarn(s) 22 into tight engagement with the already woven portion of the fabric 10A–10E. Then, the heddles are moved to create the next desired shed configuration and another CMD yarn(s) 22 is inserted into the shed. Those of skill in the art will appreciate from this disclosure that the MD warp yarns 20 can be formed of single yarns and at least a portion of the CMD weft yarns 22 can be formed of yarn assemblies 12 without departing from the scope of the present invention.

When using a flat weaving process, seam loops 28 are created along a fabric seam edge 24 once the fabric 10A–10E has been woven to allow the flat woven fabric(s) 10A–10E to be formed into an endless belt. To create the seam loops 28, once the fabric 10A–10E is initially woven, a portion of the fabric 10A–10E proximate to the seam edge 24 is unwoven. Then, some of the MD yarns 20 are re-woven back into the fabric 10A–10E to form the seam loops 28. To join flat woven fabric(s) in an endless configuration, seam edges 24 are positioned to align seam loops 28 from abutting seam edges 24. Once the seam loops are aligned, a pintle (not shown) is inserted into the seam loops 28 to connect the fabric(s) 10A–10E in an endless belt configuration. Various techniques for forming seam loops in the fabric 10A–10E are described after the description of the preferred weaves.

First Preferred Weave

Figure 2:
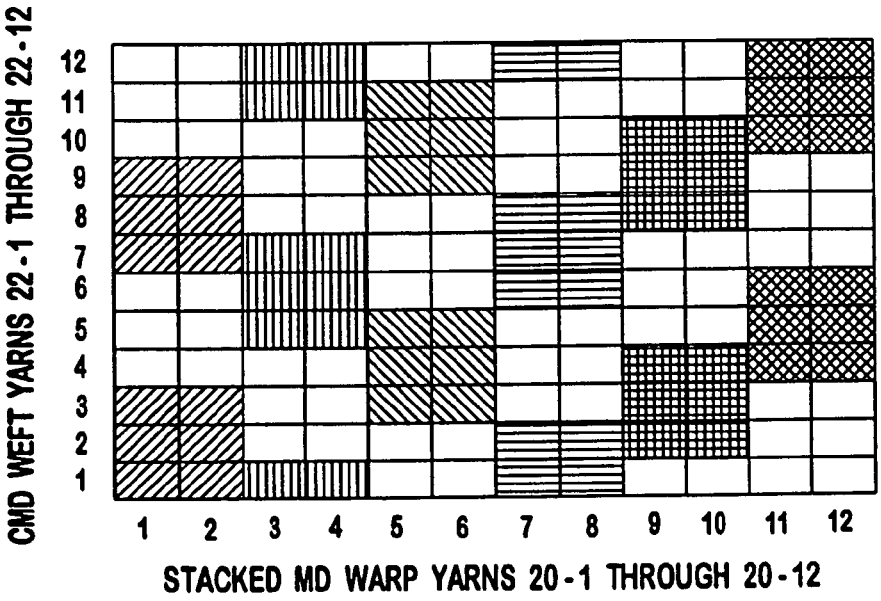
FIG. 2 is a weave diagram for the industrial fabric of FIG. 1.

Referring to FIGS. 1 and 2, the first preferred fabric 10A is formed using a six (6) shed weave. Twelve (12) paired MD warp yarns 20-1 through 20-12 are shown in FIG. 1. FIG. 2 shows the position of inserted CMD weft yarns 22-1 through 22-12 relative to the paired MD warp yarns 20-1 through 20-12. Specifically, the weave diagram of FIG. 2 identifies whether paired MD yarns 20-1 through 20-12 are positioned above or below the CMD weft yarns 22-1 through 22-12. A blank entry on the diagram represents that the corresponding CMD weft yarn 22 passes above the corresponding stacked paired MD yarns 20. For example, CMD weft yarn 22-1 is positioned above stacked MD warp yarns 20-5, 20-6, 20-9, 20-10, 20-11 and 20-12. Each of the weave diagrams shown in FIGS. 4, 6, 8 and 10 should be interpreted in a similar manner as detailed above.

The first preferred fabric 10A uses a single layer of CMD weft yarns 22 and is woven as follows. The stacked MD warp yarns 20-1 through 20-12 are moved into a first shed configuration and CMD weft yarn 22-1 is inserted under stacked MD warp yarns 20-1 through 20-4, over stacked MD warp yarns 20-5 and 20-6, under stacked MD warp yarns 20-7 and 20-8 and over stacked MD warp yarns 20-9 through 20-12.

Then, the stacked MD warp yarns 20-1 through 20-12 are moved into a second shed configuration. Once the stacked MD warp yarns 20-1 through 20-12 are in the second shed configuration, CMD weft yarn 22-2 is inserted under stacked MD warp yarns 20-1 and 20-2, over stacked MD warp yarns 20-3 through 20-6, under stacked MD warp yarns 20-7 through 20-10 and over stacked MD warp yarns 20-11 and 20-12.

Then, the stacked MD warp yarns 20-1 through 20-12 are moved into the third shed configuration. Once the stacked MD warp yarns 20-1 through 20-12 are in the third shed configuration, CMD weft yarn 22-3 is inserted under stacked MD warp yarns 20-1 and 20-2, over stacked MD warp yarns 20-3 and 20-4, under stacked MD warp yarns 20-5 and 20-6, over stacked MD warp yarns 20-7 and 20-8, under stacked MD warp yarns 20-9 and 20-10 and over stacked MD warp yarns 20-11 and 20-12.

Then, the stacked MD warp yarns 20-1 through 20-12 are moved into the fourth shed configuration. Once the stacked MD warp yarns 20-1 through 20-12 are in the fourth shed configuration, CMD weft yarn 22-4 is inserted over stacked MD warp yarns 20-1 through 20-4, under stacked MD warp yarns 20-5 and 20-6, over stacked MD warp yarns 20-7 and 20-8 and under stacked MD warp yarns 20-9 through 20-12.

Then, the stacked MD warp yarns 20-1 through 20-12 are moved into the fifth shed configuration. Once the stacked MD warp yarns 20-1 through 20-12 are in the fifth shed configuration, CMD weft yarn 22-5 is inserted over stacked MD warp yarns 20-1 and 20-2, under stacked MD warp yarns 20-3 through 20-6, over stacked MD warp yarns 20-7 through 20-10 and under stacked MD warp yarns 20-11 and 20-12.

Then, the stacked MD warp yarns 20-1 through 20-12 are moved into the sixth shed configuration. Once the stacked MD warp yarns 20-1 through 20-12 are in the sixth shed configuration, CMD weft yarn 22-6 is inserted over stacked MD warp yarns 20-1 and 20-2, under stacked MD warp yarns 20-3 and 20-4, over stacked MD warp yarns 20-5 and 20-6, under stacked MD warp yarns 20-7 and 20-8, over stacked MD warp yarns 20-9 and 20-10 and under stacked MD warp yarns 20-11 and 20-12.

The above described weave is repeated throughout the fabric 10A. After the fabric 10A is completed, a seam zone 26, proximate to the seam edge 24 is preferably unwoven and rewoven to form seam loops 28 (further described below) which may cause the weave to vary in the seam zone 26 without causing the resulting fabric 10A to depart from the scope of the present invention.

Second Preferred Weave

Figure 3:
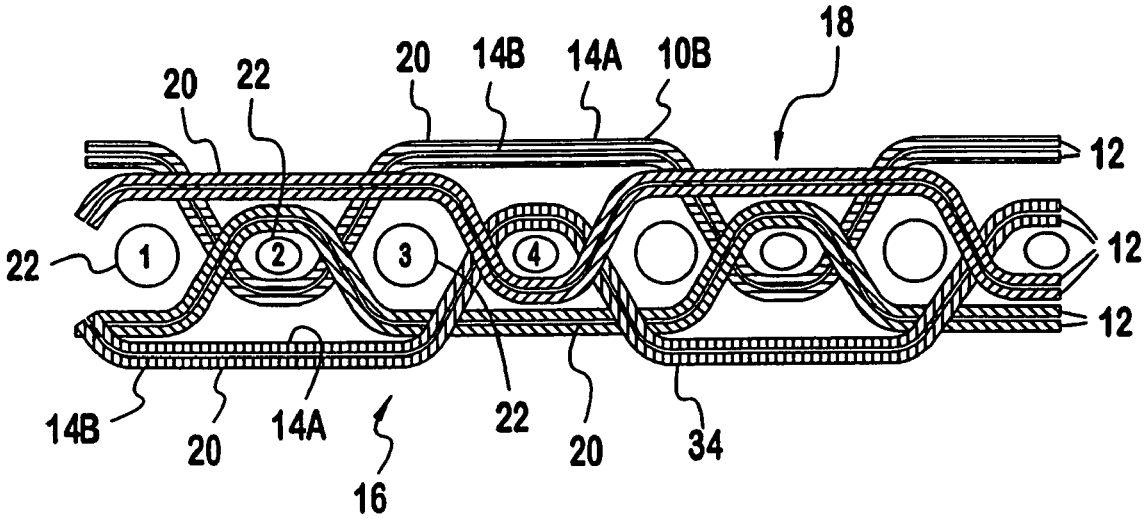
FIG. 3 is a side view showing the arrangement of warp and weft yarns in a second preferred embodiment of an industrial fabric according to the present invention.
Figure 4:
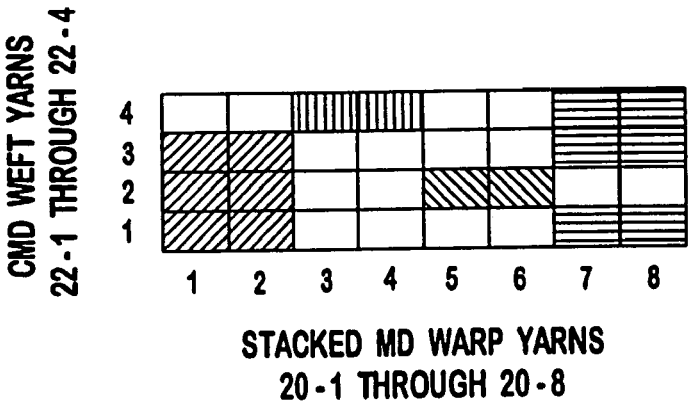
FIG. 4 is a weave diagram for the industrial fabric of FIG. 3.

Referring to FIGS. 3 and 4, the second preferred fabric 10B is formed using a four (4) shed weave and using CMD yarns 22 having varying thicknesses, i.e., varying cross-sectional areas. The fabric is woven as follows.

The stacked MD warp yarns 20-1 through 20-8 are moved into the first shed configuration. Once the stacked MD warp yarns 20-1 through 20-8 are in the first shed configuration, CMD weft yarn 22-1 is inserted under stacked MD warp yarns 20-1 and 20-2, over stacked MD warp yarns 20-3 through 20-6 and under stacked MD warp yarns 20-7 and 20-8.

Then, the stacked MD warp yarns 20-1 through 20-8 are moved into the second shed configuration. Once the stacked MD warp yarns 20-1 through 20-8 are in the second shed configuration, CMD weft yarn 22-2 is inserted under stacked MD warp yarns 20-1 and 20-2, over stacked MD warp yarns 20-3 and 20-4, under stacked MD warp yarns 20-5 and 20-6 and over stacked MD warp yarns 20-7 and 20-8.

Then, the stacked MD warp yarns 20-1 through 20-8 are moved into the third shed configuration. Once the stacked MD warp yarns 20-1 through 20-8 are in the third shed configuration, CMD weft yarn 22-3 is inserted under stacked MD warp yarns 20-1 and 20-2, over stacked MD warp yarns 20-3 through 20-6 and under stacked MD warp yarns 20-7 and 20-8.

Then, the stacked MD warp yarns 20-1 through 20-8 are moved into the fourth shed configuration. Once the stacked MD warp yarns 20-1 through 20-8 are in the fourth shed configuration, CMD weft yarn 22-4 is inserted over stacked MD warp yarns 20-1 and 20-2, under stacked MD warp yarns 20-3 and 20-4, over stacked MD warp yarns 20-5 and 20-6 and under stacked MD warp yarns 20-7 and 20-8.

The above described weave is repeated throughout the fabric 10B. After the fabric 10B is completed, a seam zone 26 proximate to the seam edge 24 is preferably unwoven and rewoven to form seam loops 28 which may cause the weave to vary in the seam zone 26 without causing the resulting fabric 10B to depart from the scope of the present invention.

Third Preferred Weave

Figure 5:
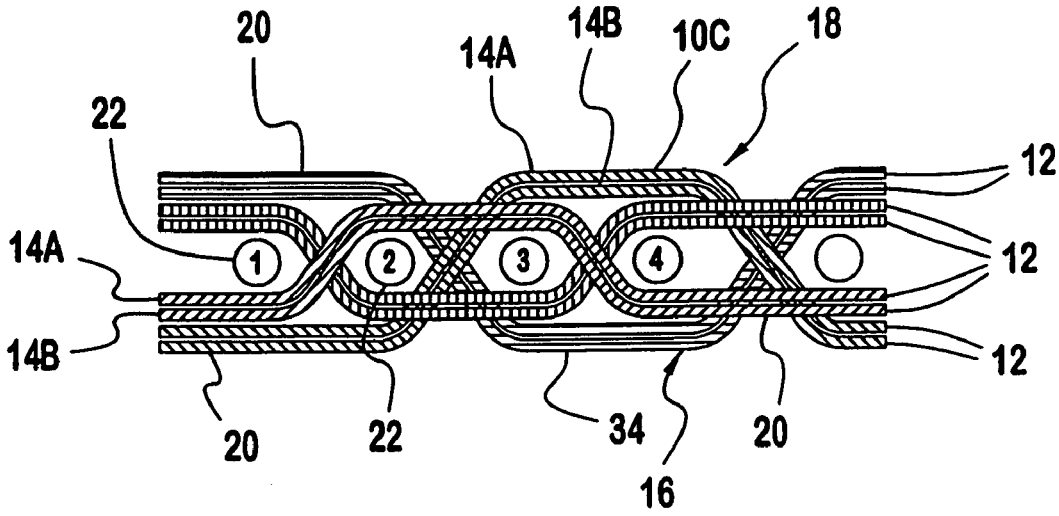
FIG. 5 is a side view showing the arrangement of warp and weft yarns in a third preferred embodiment of an industrial fabric according to the present invention.
Figure 6:
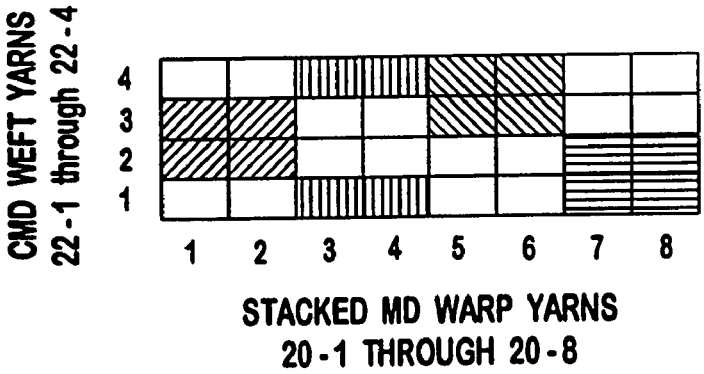
FIG. 6 is a weave diagram corresponding to the industrial fabric of FIG. 5.

Referring to FIGS. 5 and 6, the third preferred fabric 10C is formed using a four (4) shed weave as follows. The stacked MD warp yarns 20-1 through 20-8 are moved into the first shed configuration and CMD weft yarn 22-1 is inserted over stacked MD warp yarns 20-1 and 20-2, under stacked MD warp yarns 20-3 and 20-4, over stacked MD warp yarns 20-5 and 20-6 and under stacked MD warp yarns 20-7 and 20-8.

Then, the stacked MD warp yarns 20-1 through 20-8 are moved into the second shed configuration. Once the stacked MD warp yarns 20-1 through 20-8 are in the second shed configuration, CMD weft yarn 22-2 is inserted under stacked MD warp yarns 20-1 and 20-2, over stacked MD warp yarns 20-3 through 20-6 and under stacked MD warp yarns 20-7 and 20-8.

Then, the stacked MD warp yarns 20-1 through 20-8 are moved into the third shed configuration. Once the stacked MD warp yarns 20-1 through 20-8 are in the third shed configuration, CMD weft yarn 22-3 is inserted under stacked MD warp yarns 20-1 and 20-2, over stacked MD warp yarns 20-3 and 20-4, under stacked MD warp yarns 20-5 and 20-6 and over stacked MD warp yarns 20-7 and 20-8.

Then, the stacked MD warp yarns 20-1 through 20-8 are moved into the fourth shed configuration. Once the stacked MD warp yarns 20-1 through 20-8 are in the fourth shed configuration, CMD weft yarn 22-4 is inserted over stacked MD warp yarns 20-1 and 20-2, under stacked MD warp yarns 20-3 through 20-6 and over stacked MD warp yarns 20-7 and 20-8.

The above described weave is repeated throughout the fabric 10C. After the fabric 10C is completed, a seam zone 26 proximate to the seam edge 24 is preferably unwoven and rewoven to form seam loops 28 which may cause the weave to vary in the seam zone 26 without causing the resulting fabric 10C to depart from the scope of the present invention.

Fourth Preferred Weave

Figure 7:
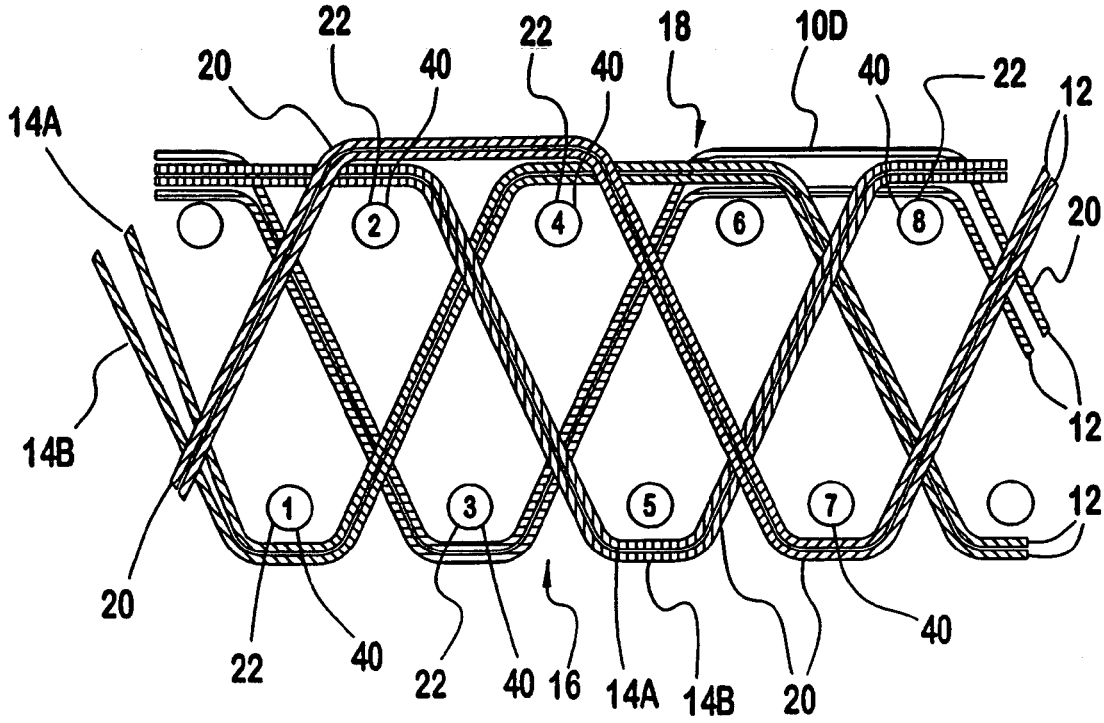
FIG. 7 is a side view showing the arrangement of warp and weft yarns in a fourth preferred embodiment of an industrial fabric according to the present invention.
Figure 8:
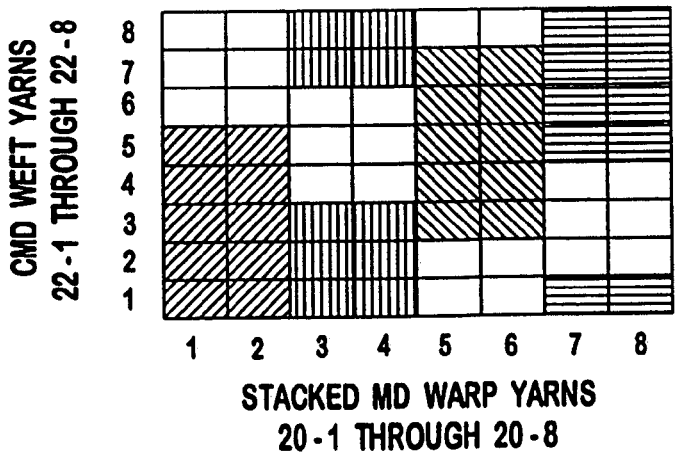
FIG. 8 is a weave diagram for the industrial fabric of FIG. 7.

Referring to FIGS. 7 and 8, the fourth preferred fabric 10D is an eight (8) shed weave with a double layer of CMD yarns that are preferably vertically offset. The fabric 10D is woven as follows.

The stacked MD warp yarns 20-1 through 20-8 are moved into the first shed configuration. Once the stacked MD warp yarns 20-1 through 20-8 are in the first shed configuration, CMD weft yarn 22-1 is inserted under stacked MD warp yarns 20-1 through 20-4, over stacked MD warp yarns 20-5 and 20-6 and under stacked MD warp yarns 20-7 and 20-8.

Then, the stacked MD warp yarns 20-1 through 20-8 are moved into the second shed configuration. Once the stacked MD warp yarns 20-1 through 20-8 are in the second shed configuration, CMD weft yarn 22-2 is inserted under stacked MD warp yarns 20-1 through 20-4 and over stacked MD warp yarns 20-5 through 20-8.

Then, the stacked MD warp yarns 20-1 through 20-8 are moved into the third shed configuration. Once the stacked MD warp yarns 20-1 through 20-8 are in the third shed configuration, CMD weft yarn 22-3 is inserted under stacked MD warp yarns 20-1 through 20-6 and over stacked MD warp yarns 20-7 and 20-8.

Then, the stacked MD warp yarns 20-1 through 20-8 are moved into the fourth shed configuration. Once the stacked MD warp yarns 20-1 through 20-8 are in the fourth shed configuration, CMD weft yarn 22-4 is inserted under stacked MD warp yarns 20-1 and 20-2, over stacked MD warp yarns 20-3 and 20-4, under stacked MD warp yarns 20-5 and 20-6 and over stacked MD warp yarns 20-7 and 20-8.

Then, the stacked MD warp yarns 20-1 through 20-8 are moved into the fifth shed configuration. Once the stacked MD warp yarns 20-1 through 20-8 are in the fifth shed configuration, CMD weft yarn 22-5 is inserted under stacked MD warp yarns 20-1 and 20-2, over stacked MD warp yarns 20-3 and 20-4 and under stacked MD warp yarns 20-5 through 20-8.

Then, the stacked MD warp yarns 20-1 through 20-8 are moved into the sixth shed configuration. Once the stacked MD warp yarns 20-1 through 20-8 are in the sixth shed configuration, CMD weft yarn 22-6 is inserted over stacked MD warp yarns 20-1 through 20-4 and under stacked MD warp yarns 20-5 through 20-8.

Then, the stacked MD warp yarns 20-1 through 20-8 are moved into the seventh shed configuration. Once the stacked MD warp yarns 20-1 through 20-8 are in the seventh shed configuration, CMD weft yarn 22-7 is inserted over stacked MD warp yarns 20-1 and 20-2 and under stacked MD warp yarns 20-3 through 20-8.

Then, the stacked MD warp yarns 20-1 through 20-8 are moved into the eighth shed configuration. Once the stacked MD warp yarns 20-1 through 20-8 are in the eighth shed configuration, CMD weft yarn 22-8 is inserted over stacked MD warp yarns 20-1 and 20-2, under stacked MD warp yarns 20-3 and 20-4, over stacked MD warp yarns 20-5 and 20-6 and under stacked MD warp yarns 20-7 and 20-8.

The above described weave is repeated throughout the fabric 10D. After the fabric 10D is completed, a seam zone 26 proximate to the seam edge 24 is preferably unwoven and rewoven to form seam loops 28 which may cause the weave to vary in the seam zone 26 without causing the resulting fabric 10D to depart from the scope of the present invention.

Fifth Preferred Weave

Figure 9:
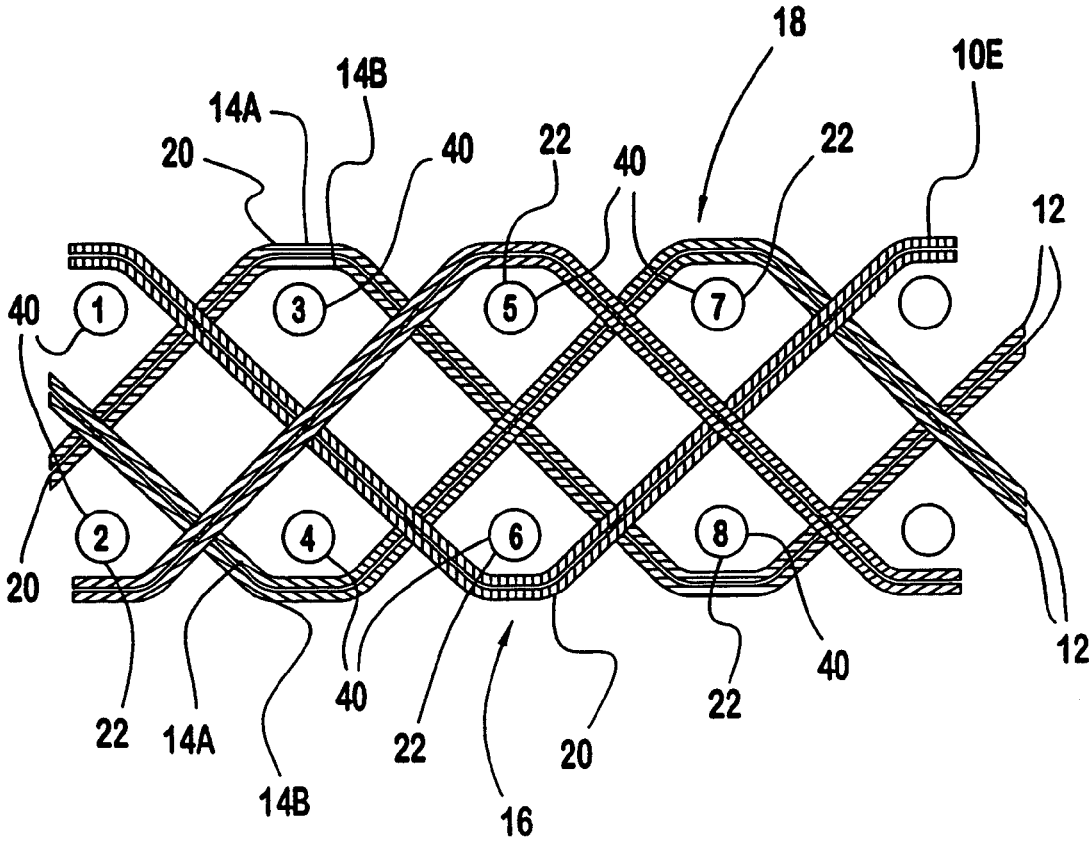
FIG. 9 is a side view showing the arrangement of warp and weft yarns in a fifth preferred embodiment of an industrial fabric according to the present invention.
Figure 10:
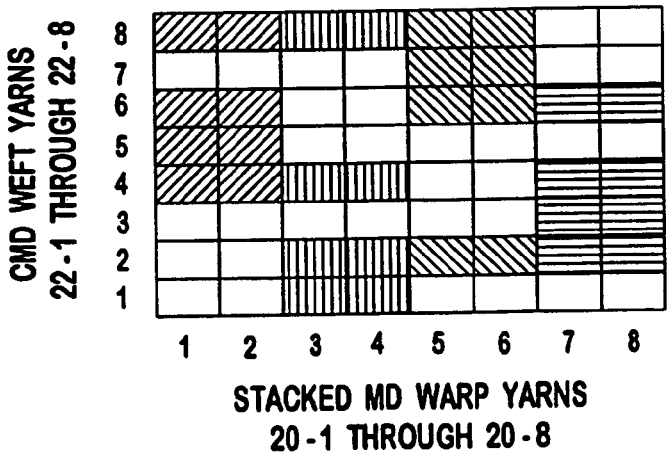
FIG. 10 is a weave diagram for the industrial fabric of FIG. 9.

Referring to FIGS. 9 and 10, the fifth preferred fabric 10E is formed using an eight (8) shed weave and uses a double layer of CMD yarns that are preferably generally vertically aligned. The fabric 10E is woven as follows.

The stacked MD warp yarns 20-1 through 20-8 are moved into the first shed configuration. Once the stacked MD warp yarns 20-1 through 20-8 are in the first shed configuration, CMD weft yarn 22-1 is inserted over stacked MD warp yarns 20-1 and 20-2, under stacked MD warp yarns 20-3 and 20-4 and over stacked MD warp yarns 20-5 through 20-8.

Then, the stacked MD warp yarns 20-1 through 20-8 are moved into the second shed configuration. Once the stacked MD warp yarns 20-1 through 20-8 are in the second shed configuration, CMD weft yarn 22-2 is inserted over stacked MD warp yarns 20-1 and 20-2 and under stacked MD warp yarns 20-3 through 20-8.

Then, the stacked MD warp yarns 20-1 through 20-8 are moved into the third shed configuration. Once the stacked MD warp yarns 20-1 through 20-8 are in the third shed configuration, CMD weft yarn 22-3 is inserted over stacked MD warp yarns 20-1 through 20-6 and under stacked MD warp yarns 20-7 and 20-8.

Then, the stacked MD warp yarns 20-1 through 20-8 are moved into the fourth shed configuration. Once the stacked MD warp yarns 20-1 through 20-8 are in the fourth shed configuration, CMD weft yarn 22-4 is inserted under stacked MD warp yarns 20-1 through 20-4, over stacked MD warp yarns 20-5 and 20-6 and under stacked MD warp yarns 20-7 and 20-8.

Then, the stacked MD warp yarns 20-1 through 20-8 are moved into the fifth shed configuration. Once the stacked MD warp yarns 20-1 through 20-8 are in the fifth shed configuration, CMD weft yarn 22-5 is inserted under stacked MD warp yarns 20-1 and 20-2 and over stacked MD warp yarns 20-3 through 20-8.

Then, the stacked MD warp yarns 20-1 through 20-8 are moved into the sixth shed configuration. Once the stacked MD warp yams 20-1 through 20-8 are in the sixth shed configuration, CMD weft yarn 22-6 is inserted under stacked MD warp yarns 20-1 and 20-2, over stacked MD warp yarns 20-3 and 20-4 and under stacked MD warp yarns 20-5 through 20-8.

Then, the stacked MD warp yarns 20-1 through 20-8 are moved into the seventh shed configuration. Once the stacked MD warp yarns 20-1 through 20-8 are in the seventh shed configuration, CMD weft yarn 22-7 is inserted over stacked MD warp yarns 20-1 through 20-4, under stacked MD warp yarns 20-5 and 20-6 and over stacked MD warp yarns 20-7 and 20-8.

Then, the stacked MD warp yarns 20-1 through 20-8 are moved into the eighth shed configuration. Once the stacked MD warp yarns 20-1 through 20-8 are in the eighth shed configuration, CMD weft yarn 22-8 is inserted under stacked MD warp yarns 20-1 through 20-6 and over stacked MD warp yarns 20-7 and 20-8.

The above described weave is repeated throughout the fabric 10E. After the fabric 10E is completed, a seam zone 26 proximate to the seam edge 24 is preferably unwoven and rewoven to form seam loops 28 which may cause the weave to vary in the seam zone 26 without causing the resulting fabric 10E to depart from the scope of the present invention.

The properties of five sample fabrics woven in accordance with the above-described five preferred weaves are listed below for experimental fabrics. The experimental data was selected by weaving multiple fabrics for each of the preferred weaves and selecting the fabrics that exhibited not only superior physical properties, but also possessed improved seamability and weaving efficiency.

TABLE 1

EXPERIMENTALLY DETERMINED FABRIC PROPERTIES

| | Preferred Weave No. | | | | |
|---|---|---|---|---|---|
| | 1 | 2 | 3 | 4 | 5 |
| FIG. No. | 1 and 2 | 3 and 4 | 5 and 6 | 7 and 8 | 9 and 10 |
| Warp Size (mm) | 0.26 × 1.06 | 0.26 × 1.06 | 0.26 × 1.06 | 0.26 × 1.06 | 0.26 × 1.06 |
| Weft Size (mm) | 1.0 | 1.0 | 1.0 | 1.0 | 0.70 |
| Fabric Mesh (warp × weft) | 51 × 16 | 48 × 14 | 50.5 × 15 | 52 × 32 | 52 × 25 |
| Air Perm. (cfm) | 401 | 395 | 317 | 130 | 439 |
| Caliper (in.) | 0.078 | 0.079 | 0.071 | 0.067 | 0.078 |
| % Contact with Sheet | 8.7 | 9.3 | 13.3 | 12.9 | 6.5 |
| Elastic Modulus (pli) | 9346 | 7813 | 7042 | 6803 | 7519 |
| Tensile Strength (lb.) | 1210 | 1154 | 1110 | 1184 | 1196 |

The fabric properties were determined as follows: Air Permeability measurements were made on heat set fabric samples according to ASTM D 737-96 using a High Pressure Differential Air Permeability machine available from The Frazier Precision Instrument Company, Gaithersburg, Md. and with a pressure differential of 127 Pa through the fabric.

Percent contact with the sheet was measured in the following manner. Ink from a strip of Beloit Nip Impression paper available from Beloit Corp Manhattan Division, Clarks Summit, Pa. is transferred to the surface of the dryer fabric sample by means of heat and pressure. The ink is then transferred from the surface of the dryer fabric to a piece of copy paper. The impression is the scanned to create a digitized image from which the contact area is calculated using a computer program.

Elastic modulus was determined by placing a fabric sample which has been oriented in the machine direction under constantly increasing load in a CRE (Constant Rate of Extension) testing machine such as an Instron model 1122 Tensile Testing machine available from Instron Corp. of Canton, Mass. The elastic modulus is determined from the initial slope of the stress-strain curve of the fabric after any slackness is removed. The test provides a measure of the stretch resistance of the fabric when subjected to machine direction load which gives an indication of its long term stability on a papermaking machine Tensile strength was determined by placing a fabric sample under tensile load to catastrophic failure using a CRE (Constant Rate of Extension) testing machine such as an Instron model 1122 Tensile Testing machine available from Instron Corp. of Canton, Mass. This test provides a measure of the stress-strain characteristics of a fabric.

Referring to FIGS. 16–24, as mentioned above, the described preferred fabrics 10A–10E can be manufactured with warp and/or weft yarns that are each formed by first and second yarns 14A, 14B that may have complementary, interlocking, cross-sectional areas or that each include one relatively large yarn with multiple smaller yarns generally aligned on a yarn receiving surface of the relatively larger yarn. However, the experimental fabrics described in Table 1 were all produced using two flat warp yarns as a yarn assembly.

Regardless of the particular weave pattern used to form the industrial fabric 10A–10E, various methods can be used to form the necessary seam loops 28 along a seam edge(s) 24 to assemble the flat woven fabric(s) 10A–10E into an endless fabric belt. In general, flat woven fabrics are partially unwoven generally throughout the seam zone 26. Then, some of the unwoven yarns are formed into seam loops. Afterwards, the ends of the seam loop forming yarns and the remaining unwoven yarns are rewoven. The unweaving and reweaving process can be carried out by hand or by machine. Some methods for forming seam loops during the reweaving process are detailed below. Each method will be discussed by explaining how one set of MD yarns 54 are positioned to form a seam loop 28. It is understood that the below described methods can be repeated for multiple sets of MD yarns 54 along a single fabric edge 24 to form a sufficient number of seam loops 28 without departing from the present invention.

Figure 11:
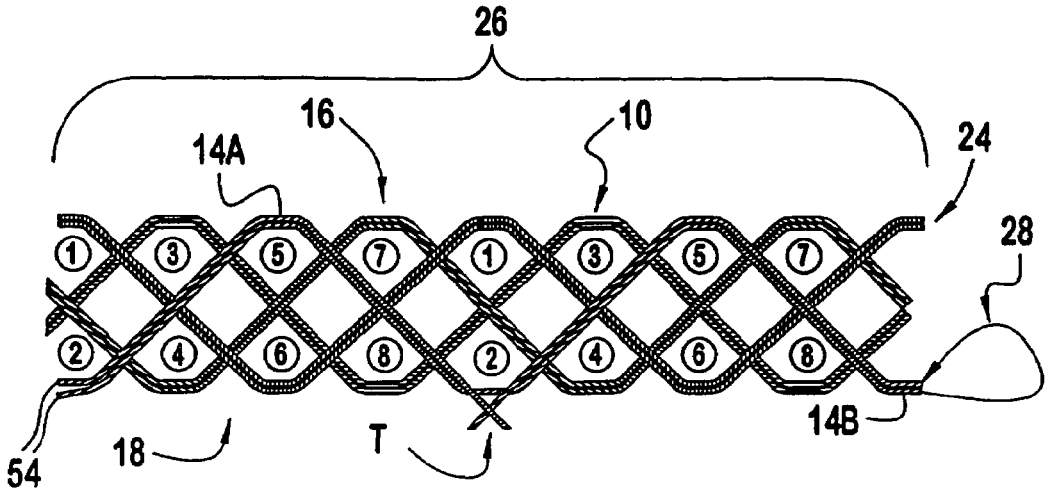
FIG. 11 is a side view showing the arrangement of warp and weft yarns in a first preferred embodiment of a seam loop according to the present invention.

The first preferred method for forming a seam loop 28 is shown in FIG. 11. To form the seam loop 28 using MD yarn pair 54, the first stacked MD yarn 14A is terminated at point "T" (in the seam zone 26) during the unweaving process. Then, second yarn 14B is positioned to form the seam loop 28 and rewoven along the remaining portion of the path of the terminated first MD yarn 14A. Once the second yarn 14B has been rewoven back to position "T" it is cut. This preferably provides a seam zone 26 having an identical weave to the remainder of the fabric 10A–10E. Those skilled in the art will appreciate from this disclosure that the fabric position at which yarns are attached, or cut and held in place by interweaving, (for any of the seam loop forming methods of the present invention) can be proximate to the paper side surface 16, to the machine side surface 18 or can be located within the fabric 10A–10E without departing from the scope of the present invention.

Figure 12:
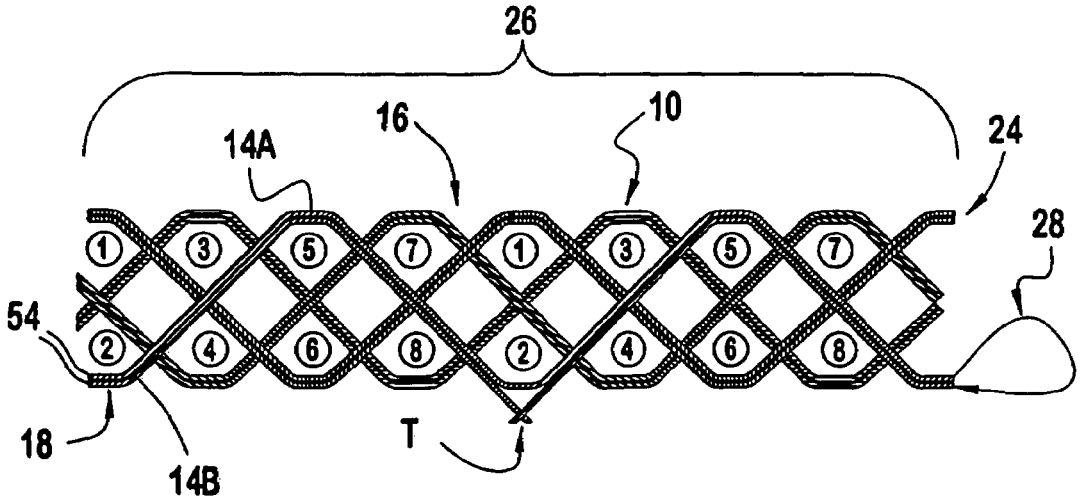
FIG. 12 is a side view showing the arrangement of warp and weft yarns in a second preferred embodiment of a seam loop according to the present invention.

A second preferred method of forming a seam loop 28 is shown in FIG. 12. To form the seam loop 28 using MD yarn pair 54, the second stacked MD yarn 14B is terminated at point "T" (in the seam zone 26) during the reweaving process. Then, the first stacked MD yarn 14A is positioned to form the seam loop 28 and rewoven along the remaining portion of the path of the terminated second stacked MD yarn 14B. Once the first yarn 14A has been rewoven back to position "T" it is cut.

Figure 13:
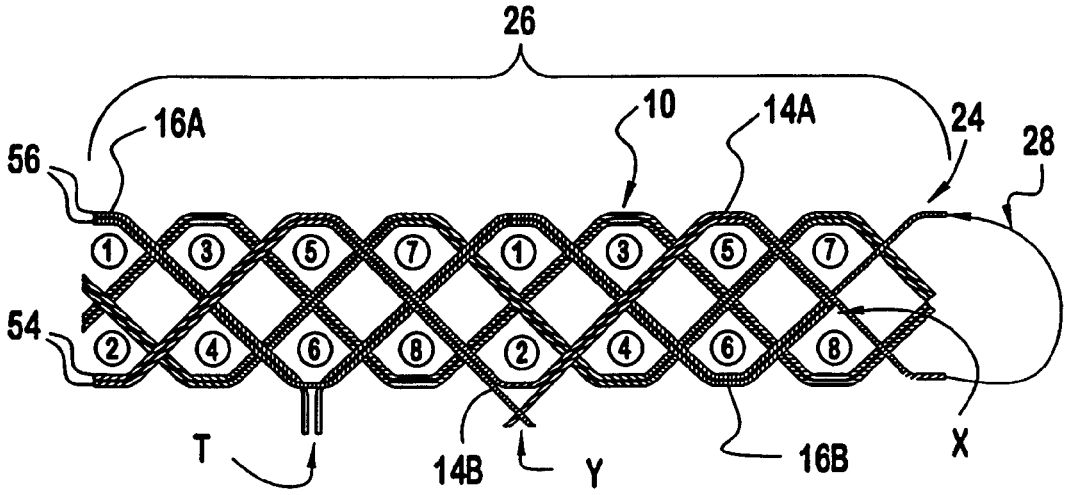
FIG. 13 is a side view showing the arrangement of warp and weft yarns in a third preferred embodiment of a seam loop according to the present invention.

A third preferred method of forming a seam loop 28 is shown in FIG. 13. The seam loop 28 is formed between the ends of MD yarn pairs 54 and 56. First, the second stacked MD yarn 14B of stacked MD yarn pair 54 is terminated proximate to position "Y" and the first stacked MD yarn 16A of the next adjacent MD yarn pair 56 is terminated at point "T" during the reweaving process. Then, the first stacked MD yarn 14A is positioned to form a seam loop 28 and is rewoven along the remaining path of the terminated MD yarn 16A of the next adjacent MD yarn pair 56 to a location proximate to point "T." Preferably, the rewoven portion of the first stacked MD yarn 14A is retained solely by its interweaving into the fabric 10A–10E. During the reweaving process, the second stacked MD yarn 16B of the next adjacent yarn pair 56 is rewoven along the remaining path of the terminated second stacked MD yarn 14B.

Figure 14:
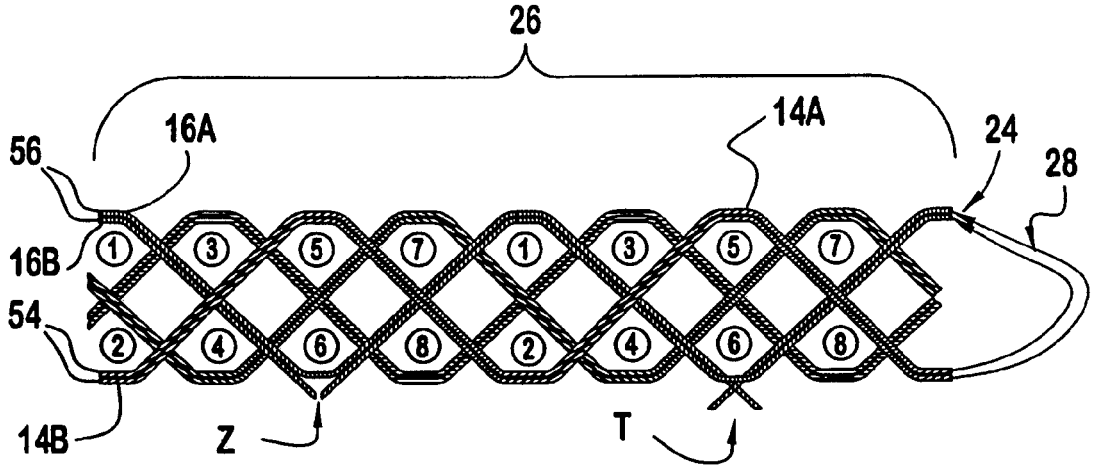
FIG. 14 is a side view showing the arrangement of warp and weft yarns in a fourth preferred embodiment of a seam loop according to the present invention.

A fourth preferred method of forming a seam loop 28 is shown in FIG. 14. To form a seam loop 28 using MD yarn pair 54, the second stacked MD yarn 16B in the next adjacent MD yarn pair 56 is terminated proximate to position "Z" and the first stacked MD yarn 16A of the MD yarn pair 56 is terminated proximate to position "T" in the reweaving process. Then, the first and second stacked MD yarns 14A, 14B are positioned to form a stacked seam loop 28 and to follow the remaining path of the second and first stacked MD yarns 16B, 16A of the MD yarn pair 56, respectively. The rewoven second stacked MD yarn 14B is rewoven to a position proximate to location "T" and is preferably cut there. The rewoven first stacked MD yarn 14A extends along the remaining path of the terminated second stacked MD yarn 16B of the next adjacent stacked MD yarn pair 56 proximate to position "Z." The rewoven ends of the first and second stacked MD yarns 14A, 14B are preferably maintained in position by interweaving alone. The termination points are preferably staggered to provide improved seam loop strength.

Figure 15:
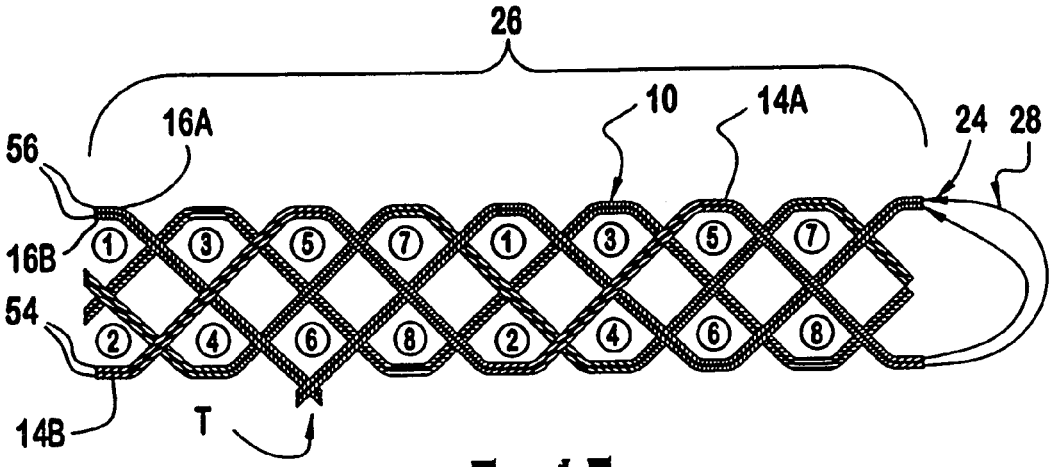
FIG. 15 is a side view showing the arrangement of warp and weft yarns in a fifth preferred embodiment of a seam loop according to the present invention.

A fifth preferred method of forming a seam loop 28 is shown in FIG. 15. To form a seam loop 28 using MD yarn pair 54, first and second stacked MD yarns 16A, 16B in the next adjacent MD yarn pair 56 are terminated proximate to position "T" during the unweaving process. During the reweaving process, first and second stacked MD yarns 14A, 14B are positioned to form a seam loop 28 comprising the two yarns 14A and 14B and are rewoven along the remaining path of the terminated first and second stacked MD yarns 16A, 16B in the next adjacent MD yarn pair 56 to a position proximate to point "T." It is preferred that the first and second stacked MD yarns 14A, 14B are held in place by interweaving only.

Figure 26:
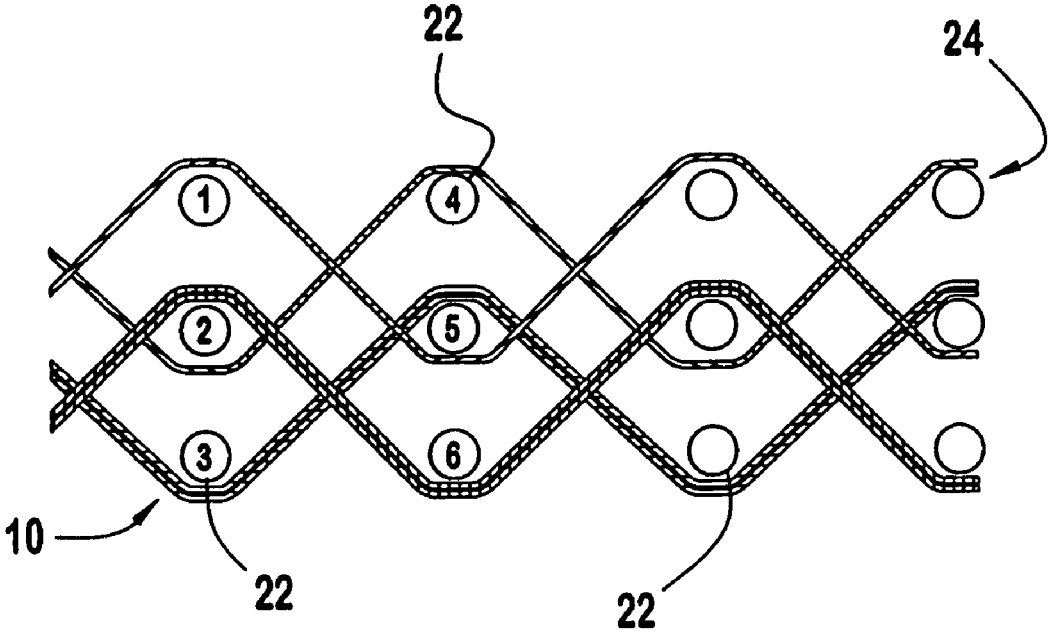
FIG. 26 is a schematically drawn side view of a three layer industrial fabric according to the present invention having stacked MD yarns forming yarn assemblies.

Referring to FIG. 26, it is possible to have three or more layers of CMD weft yarns 22-1 through 22-6 in the fabric 10A–10E. Furthermore, each of the individual CMD weft yarns 22-1 through 22-6 can be formed as yarn assemblies 12 consisting of a pair of yarns having complementary, interlocking cross-sectional shapes without departing from the scope of the present invention.

Figure 27:
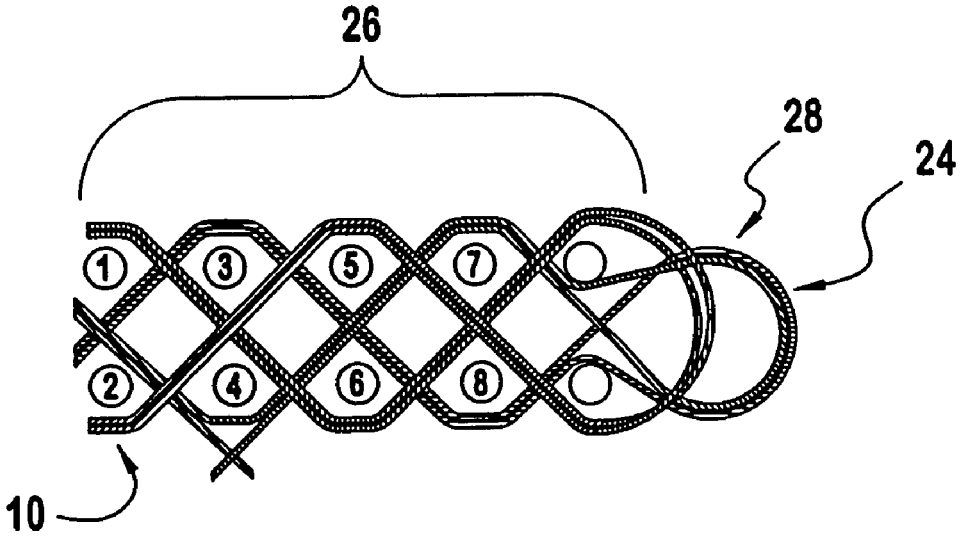
FIG. 27 is a schematically drawn side view of an arrangement of seam loops according to the present invention.

FIG. 27 shows an alternate seam configuration in accordance with the present invention. The seam zone 26 has seam loops 28 formed in a manner similar to that shown in FIG. 12. As indicated, seam loops 28 are preferably formed on every other MD yarn assembly so that the opposing ends of a fabric 10A–10E can be connected together while keeping the MD yarn assembly aligned across the seam 24.

Referring to FIGS. 28–30, the CMD yarns 22 can be formed by first and second yarns having complementary, interlocking cross-sections. In FIG. 28, first stacked MD yarn 14A is back woven into the fabric 10A–10E along the path of the second stacked MD yarn 14B and terminates at point "T" proximate to the end of second stacked MD yarn 14B. Thus, seam loop 28 is held in place by the interweaving of first stacked MD yarn 14A back into the fabric 10A–10E.

FIGS. 29 and 30 illustrate a method of further securing back woven stacked MD yarns in the fabric 10A–10E by positioning the back woven stacked MD yarns between the first and second stacked CMD yarns that form the CMD weft yarn assembly 22. When the fabric is in tension, this has the desired effect of creating pressure between first and second stacked yarns forming CMD yarn assembly 22 thereby securing the back woven stacked MD yarns 20 in position in the seam zone 26.

Referring to FIG. 29, the second stacked MD yarn 14B is back woven into the fabric 10A–10E along the remainder of the path of the first stacked MD yarn 14A to a location proximate to a point "T." Both the back woven second stacked MD yarn 14B and the first stacked MD yarn 14A extend between the stacked yarns 17A, 17B of a stacked CMD weft yarn pair.

Referring to FIG. 30, a seam loop 28 is formed using MD yarn assembly 54 by terminating first stacked MD yarn 16A in the next adjacent MD yarn assembly 56 proximate to point "Z" and by terminating second stacked MD yarn 16B in the next adjacent MD yarn assembly 56 proximate to point "T" during the reweaving process. Then first and second stacked MD yarns 14A, 14B comprising yarn assembly 54 are positioned to form a stacked seam loop 28. First stacked MD yarn 14A is back woven along the remainder of the path of the second yarn 16B of the next adjacent MD yarn assembly 56 to a position proximate to location "T." The ends of yarns 14A and 16B each extend through stacked CMD yarn assemblies 22 formed by opposing yarns 17A, 17B. Second stacked MD yarn 14B is back woven along the remainder of the path of the first stacked MD yarn 16B of the next adjacent MD yarn assembly 56 to a position proximate to location "Z." The ends of second yarn 14B and the first yarn 16A extend through stacked CMD yarn assemblies 22 formed by opposing yarns 17A, 17B.

It is also possible to use CMD yarn assemblies in the seam area only so as to secure the MD yarns upon reweaving and provide high strength seaming loops. In this type of seam construction, a portion of the CMD yarns, less than 5 on each side of the assembled seam, are replaced with CMD yarn assemblies such as are illustrated in FIGS. 25 and 28–30. During reweaving of the MD yarns 14 following formation of the seaming loops 28, the MD yarns are tucked between the component yarns of the CMD yarn assemblies 22. The fabric is then tensioned and heatset, causing the CMD yarn assemblies to be brought together and securely lock the MD yarns in position.

As detailed above, the fabrics 10A–10E of the present invention can be easily customized to meet any desired papermaking machine requirements. The ability to incorporate differing yarn materials, sizes and shapes into the yarn assemblies makes fabric construction very flexible. The fabrics 10A–10E are very rugged and stable. Fabric surface characteristics can be customized by using textured or surface treated yarns, to improve sheet release or other qualities. High strength, low profile seam loops 28 can be formed in most designs; the seams are easier to assemble and make than those in similar prior art designs. This is accomplished by conjoining two or more yarns in a weaving process that allows the weaver to use one, two or three backbeams of warp material, and interchange it to meet the next fabric's requirements. More than one type of warp yarn can be wound onto the same creel and the desired warp can be readily brought into the weave.

It is recognized by those skilled in the art that changes may be made to the above-described embodiments of the invention without departing from the broad inventive concept thereof. It is understood, therefore, that this invention is not limited to the particular embodiments disclosed, but is intended to cover all modifications which are within the spirit and scope of the invention as defined by the appended claims.

What is claimed is:

1. A woven industrial fabric, comprising:

a plurality of warp yarns interwoven with a plurality of weft yarns, wherein:

a) at least a portion of the plurality of warp yarns include a plurality of yarn assemblies;

b) each of the plurality of yarn assemblies is comprised of at least a first and a second yarn; and c) the first and second yarns are arranged in the woven fabric so as to be generally vertically stacked in relation to a fabric surface and in generally continuous, contiguous contact with each other substantially throughout the fabric.

2. The industrial fabric of claim 1, wherein the plurality of warp yarns comprises machine direction warp yarns.

3. The industrial fabric of claim 1, wherein at least a portion of the plurality of weft yarns comprises the plurality of yarn assemblies.

4. The industrial fabric of claim 1, wherein at least a portion of the plurality of warp yarns and at least a portion of the weft yarns comprise the plurality of yarn assemblies.

5. The industrial fabric of claim 1, wherein the first yarn is formed from a first material and the second yarn is formed from a second material that is different from the first material.

6. The industrial fabric of claim 5, wherein the first and second materials comprise at least one of: polyphenylene sulfide, polycyclohexamethylene terephthalic acid modified, and polyethylene terephthalate.

7. The industrial fabric of claim 5, wherein the fabric has a machine side surface having mechanical properties corresponding to the first material and has a paper side surface having mechanical properties corresponding to the second material.

8. The industrial fabric of claim 7, wherein at least one surface of the second yarn is textured to provide a desired surface characteristic to the paper side surface of the fabric.

9. The industrial fabric of claim 8, wherein at least one surface of the second yarn is textured by one of placing ribs thereon, placing grooves therein, roughening, and placing a coating thereon.

10. The industrial fabric of claim 1, wherein the first and second yarns each have a complementary, cross-sectional shape such that the first and second yarns cooperatively interlock to resist misalignment.

11. The industrial fabric of claim 1, wherein at least a portion of the plurality of yarn assemblies are interwoven in the fabric so as to form floats which extend over at least four (4) cross-direction yarns.

12. The industrial fabric of claim 1, wherein the plurality of yarn assemblies comprises a first yarn in a stacked relationship with at least two second yarns so that each of the at least two second yarns is in contact with the first yarn substantially throughout the fabric.

13. The industrial fabric of claim 12, wherein the first yarn has a generally rectangular, cross-sectional shape providing a yarn receiving surface adapted to receive the at least two second yarns.

14. The industrial fabric of claim 13, wherein at least one yarn receiving groove is located in the yarn receiving surface to receive the at least two second yarns.

15. The industrial fabric of claim 13, wherein a separate yarn receiving groove is provided in the yarn receiving surface for each of the at least two second yarns to prevent misalignment between the first yarn and the at least two second yarns.

16. The industrial fabric of claim 13, wherein the at least two second yarns each have a generally rectangular, cross-sectional shape.

17. The industrial fabric of claim 13, wherein the at least two second yarns each have a generally oblong, cross-sectional shape.

18. The industrial fabric of claim 1, wherein the first yarn has a first cross-sectional area and the second yarn has a second cross-sectional area different than the first cross-sectional area.

19. The industrial fabric of claim 1, wherein the first and second yarns each have a plurality of complementary, spaced apart protuberances capable of interlocking the first yarn to the second yarn.

20. The industrial fabric of claim 1, wherein at least a portion of the plurality of warp yarns comprise yarn assemblies and the weft yarns comprise a plurality of generally stacked weft yarn assemblies each comprising at least two yarns, capable of having a plurality of yarn assemblies interposed therebetween.

21. The industrial fabric of claim 20, wherein the fabric has at least one seam forming edge comprising a plurality of seam loops, each formed by the first yarn of the plurality of warp yarn assemblies, wherein the second yarn terminates at a location spaced from the seam forming edge and the first yarn forms a seam loop and is woven back into the fabric along a second yarn path proximate to the location where the second yarn is terminated.

22. The industrial fabric of claim 21, wherein the location where the second yarn is terminated is proximate to one of a machine side surface and a paper side surface.

23. The industrial fabric of claim 21, wherein the location where the second yarn is terminated is generally between one of the generally stacked weft yarn pairs.

24. The industrial fabric of claim 1, wherein each of the plurality of yarn assemblies is free of any yarns interwoven between the corresponding at least first and second yarns thereof.

25. The industrial fabric of claim 1, wherein a portion of the fabric proximate to a seam edge defines a seam zone with a plurality of seam loops formed by the plurality of warp yarns, wherein at least some of the plurality of warp yarns used to form the seam loops extend between at least one of a plurality of weft yarn assemblies in the seam zone.

26. A woven industrial fabric, comprising:

a plurality of warp yarns interwoven with a plurality of weft yarns, wherein:

a) at least a portion of one of the plurality of warp yarns and the plurality of weft yarns includes a plurality of yarn assemblies;

b) each of the plurality of yarn assemblies is comprised of at least a first and a second yarn; and c) the first and second yarns are arranged in the woven fabric so as to be in generally continuous, contiguous contact with each other substantially throughout the fabric, wherein the fabric has a machine side surface having mechanical properties corresponding to the first material and has a paper side surface having mechanical properties corresponding to the second material.

27. A woven industrial fabric, comprising:

a plurality of warp yarns interwoven with a plurality of weft yarns, wherein:

a) at least a portion of one of the plurality of warp yarns and the plurality of weft yarns includes a plurality of yarn assemblies;

b) each of the plurality of yarn assemblies is comprised of at least a first and a second yarn; and c) the first and second yarns are arranged in the woven fabric so as to be in generally continuous, contiguous contact with each other substantially throughout the fabric, wherein the plurality of yarn assemblies comprises a first yarn in a stacked relationship with at least two second yarns so that each of the at least two second yarns is in contact with the first yarn substantially throughout the fabric.

28. A woven industrial fabric, comprising:

a plurality of warp yarns interwoven with a plurality of weft yarns, wherein:

a) at least a portion of one of the plurality of warp yarns and the plurality of weft yarns includes a plurality of yarn assemblies;

b) each of the plurality of yarn assemblies is comprised of at least a first and a second yarn; and c) the first and second yarns are arranged in the woven fabric so as to be in generally continuous, contiguous contact with each other substantially throughout the fabric, wherein at least a portion of the plurality of warp yarns comprise yarn assemblies and the weft yarns comprise a plurality of generally stacked weft yarn assemblies each comprising at least two yarns, capable of having a plurality of yarn assemblies interposed therebetween.

* * * * *